US005597330A

United States Patent [19]

Hatagishi

[11] Patent Number: 5,597,330

[45] Date of Patent: Jan. 28, 1997

[54] PRESSURE-CONTACT CONNECTOR

[75] Inventor: Yuji Hatagishi, Shizuoka, Japan

[73] Assignee: Yazaki Corporation, Tokyo, Japan

[21] Appl. No.: 528,230

[22] Filed: Sep. 14, 1995

[30] Foreign Application Priority Data

Sep. 14, 1994 [JP] Japan ..... 6-220300

[51] Int. Cl.[6] ..... H01R 13/514

[52] U.S. Cl. ..... 439/752; 439/733.1; 439/404

[58] Field of Search ..... 439/733, 752, 439/395–404, 595, 599, 600

[56] References Cited

U.S. PATENT DOCUMENTS 5,154,630 10/1992 Kamono et al. ..... 439/752

FOREIGN PATENT DOCUMENTS 1551298 8/1979 United Kingdom ..... 439/752

*Primary Examiner*—David L. Pirlot

*Attorney, Agent, or Firm*—Sughrue, Mion, Zinn, Macpeak & Seas

[57] ABSTRACT

In a pressure-contact connector in which terminal reception chambers receiving pressure-contact terminals are defined by partitions and provided side by side in a housing, notch portions cut out more deeply than an upper end of a wire pressed are formed in side plates of a pressure-contact portion of each pressure-contact terminal, the side plates being opposite to each other in a direction perpendicular to the longitudinal direction of the wire. Hollow portions are formed in the respective partitions so as to coincide with the notch portions when the pressure-contact terminals are mounted in the terminal reception chambers. A cover having a side surface opened as an insertion hole is provided so that the cover can be removably fitted to the housing horizontally. Rail-like projections are formed on the upper and lower inner surfaces of the cover so as to project therefrom so that the projections are inserted into the notch portions and the hollow portions, when the cover is fitted to the housing, so as to be disposed on the upper ends of the wires which are brought into pressure-contact.

2 Claims, 3 Drawing Sheets

PRESSURE-CONTACT CONNECTOR

BACKGROUND OF THE INVENTION

The present invention relates to a pressure-contact connector in which a wire is put onto a pressure-contact blade with pressure so as to make its core contact with the pressure-contact blade electrically, and particularly relates to an improvement of the respective structures of a cover member, a housing, and a pressure-contact terminal for the sake of improving the property for holding a wire in a pressure-contact portion.

In a pressure-contact connector in which a coated wire is put onto a pressure-contact blade with pressure so that its coating is cut and its core is electrically connected to the pressure-contact blade by pressure-contact, there is indeed an advantage in mass productivity, but there is a disadvantage that a pressure-contact portion is low in property for holding a wire against vibrations, and so on.

A pressure-contact connector in which such a disadvantage is solved and in which a wire contact means is provided in a pressure-contact portion will be described with reference to FIGS. 5 to 7 by way of example. FIG. 5 is an exploded perspective view of a conventional pressure-contact connector; FIG. 6 is a sectional view of a terminal reception chamber after assembling; and FIG. 7 is a front view showing the state where a wire is pressure-contacted.

A housing 3 in which a plurality of opening portions of terminal reception chambers 1 are opened in the upper and lower surfaces is provided so that the housing 3 is held from above and below by a pair of covers 5*a* and 5*b*, respectively. A plurality of wire contact portions 7 are provided on the inner walls of the covers 5*a* and 5*b* correspondingly to the terminal reception chambers 1 so as to project from the inner walls. When the covers 5*a* and 5*b* are fitted to the housing 3, each of the wire contact portions 7 is disposed between pressure-contact blades 9*a* and 9*b* of a pressure-contact terminal 9 received in the terminal reception chamber 1 as shown in FIG. 6. Accordingly, the contact portion contacts with a wire 15 in which a coating 11 (see FIG. 7) thereof is cut by the pressure-contact blades 9*a* and 9*b* so that the pressure-contact blades 9*a* and 9*b* contact with a core 13 of the wire 15 which has become able to be electrically contacted.

Consequently, the wire 15 is restrained from moving up and down (in the direction of arrow a in FIG. 7) by vibrations, and so on, so that the property for holding the wire 15 is improved to thereby improve the reliability in electrical contacting in the pressure-contact portion.

In such a conventional pressure-contact connector, however, the wire contact portions 7 are provided in the pair of upper and lower covers 5*a* and 5*b* respectively, and when the covers 5*a* and 5*b* are attached to each other, the wire contact portions are disposed between the pressure-contact blades 9*a* and 9*b* of the pressure-contact terminals 9 received in the terminal reception chambers 1. Accordingly, two sets of cover members are required as the covers 5*a* and 5*b*. Thus, since the number of parts are increased, disadvantageously, the cost of manufacture increases, and the management of the parts becomes troublesome.

In addition, wires 15 led out from a number of upper and lower terminal reception chambers 1 must be arranged in a wire insertion portion 17 (see FIG. 5) so as not to be trapped by the covers 5*a* and 5*b* when the covers are fitted, because the covers are constituted by two parts. Accordingly, the performance of assembling is remarkably poor.

SUMMARY OF THE INVENTION

Taking the foregoing problems into consideration, the present invention has been made and has an object to provide a pressure-contact connector in which by means of a cover of a single member, it is possible to restrain wires from moving in upper and lower terminal reception chambers and it is also possible to prevent the wires from being trapped by the cover to thereby reduce the cost of manufacture and improve the workability of assembling.

In order to attain the foregoing object, according to the present invention, there is provided a pressure-contact connector in which pressure-contact portions for pressure-contacting with wires from above are provided in pressure-contact terminals, and terminal reception chambers for receiving the pressure-contact terminals are defined by partitions and arranged side by side in the horizontal direction of a housing; wherein notch portions cut more deeply than an upper end of a wire pressure-contacted by each pressure-contact portion are formed in side plates of the pressure-contact portion which are opposite to each other in the direction perpendicular to the longitudinal direction of the wire; wherein hollow portions which coincide with the notch portions when the pressure-contact terminals are mounted in the terminal reception chambers are formed in the partitions; wherein a U-shaped cover having a side which is opened as an insertion hole is provided so that the cover is removably fitted to the housing horizontally; and wherein rail-like projections are formed on the inner surface of the cover so as to project therefrom so that the projections are inserted into the notch portions and hollow portions which coincide with each other, when the cover is fitted, so as to be disposed on the upper ends of the wires which are pressure-contacted by the pressure-contact portions.

When the pressure-contact terminals have been mounted in the terminal reception chambers of the housing, the hollow portions of the partitions coincide with the notch portions of the pressure-contact terminals so as to form a groove in the horizontal direction of the housing. When the cover is fitted to the housing, a rail-like projection of the cover is inserted into the groove so as to be disposed in the notch portions of the pressure-contact portions held in the terminal reception chambers. The rail-like projection disposed in the notch portions contacts against the upper portions of the wires which are brought into pressure-contact with the pressure-contact blades so that the wires are prevented from moving up and down.

DETAILED DESCRIPTION OF THE INVENTION

A preferred embodiment of the pressure-contact connector according to the present invention will be described below in detail with reference to the drawings.

Figure 1:
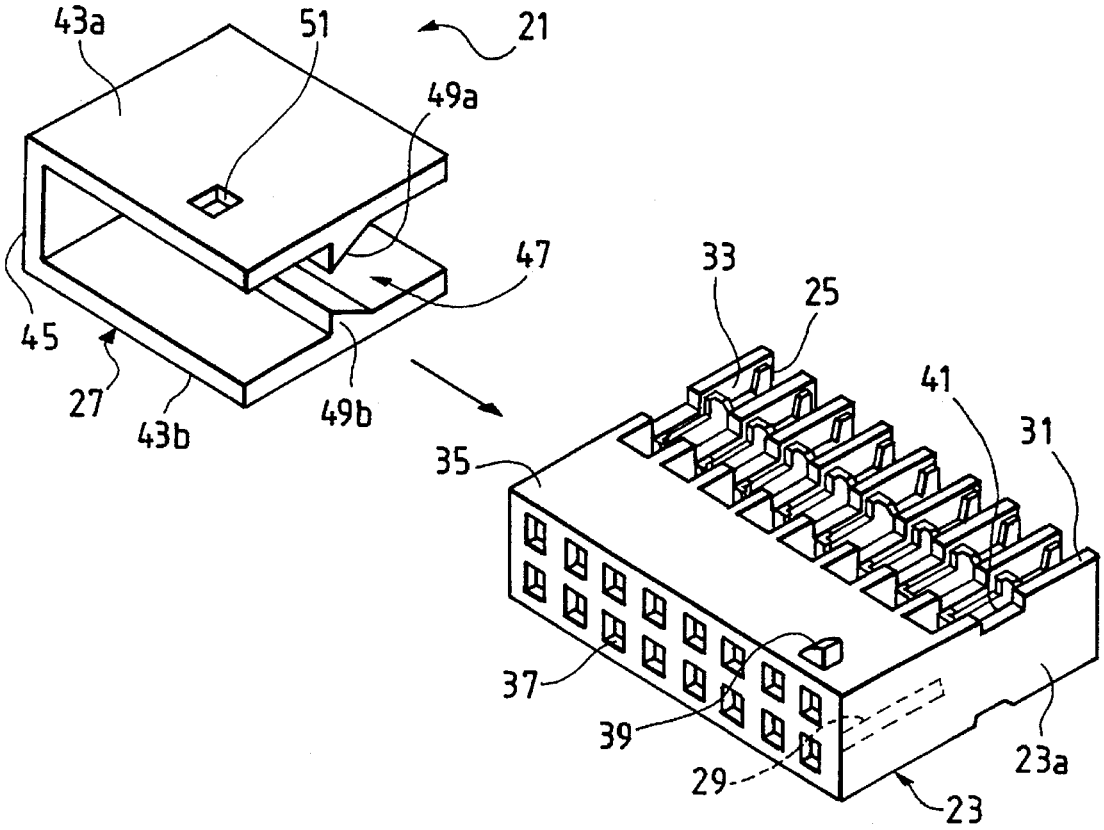
FIG. 1 is an exploded perspective view of a pressure-contact connector according to an embodiment of the present invention.
Figure 2:
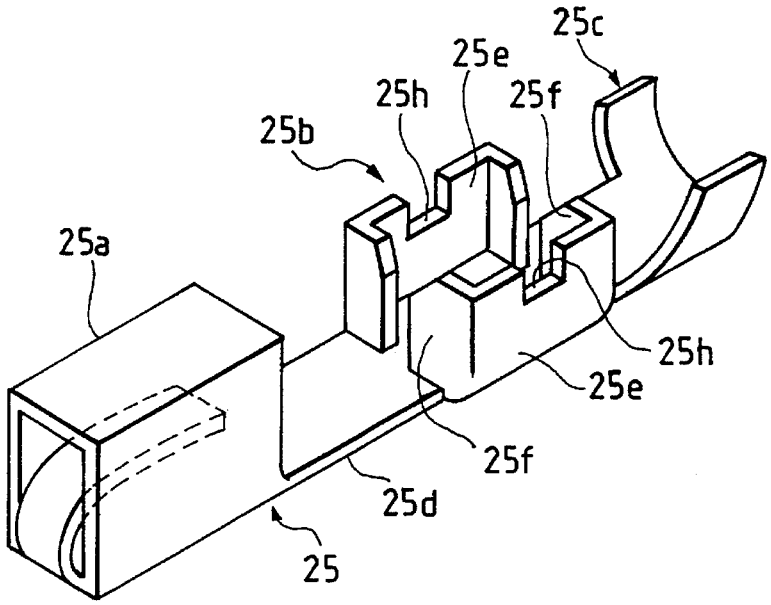
FIG. 2 is a perspective view of a pressure-contact terminal used in the pressure-contact connector in the embodiment.
Figure 3:
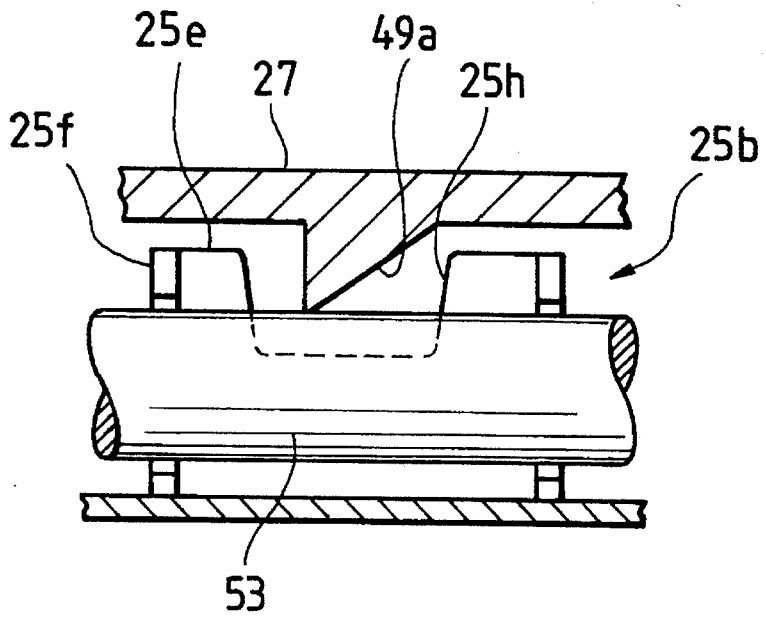
FIG. 3 is a sectional view showing a main part of the pressure-contact connector in the embodiment, FIGS. 4(*a*) and 4(*b*) are sectional views for explaining modifications of the shape of the rail-like projection.

FIG. 1 is an exploded perspective view of a pressure-contact connector according to this embodiment; FIG. 2 is a perspective view of a pressure-contact terminal used in the pressure-contact connector of this embodiment; and FIG. 3 is a sectional view showing a main part of the pressure-contact connector of this embodiment.

A pressure-contact connector 21 according to this embodiment is constituted mainly by a housing 23, pressure-contact contact terminals 25 received in the housing 23, and a cover 27 fitted to the outer periphery of the housing 23.

The housing 23 is sectioned into upper and lower stages by a horizontal partition 29 provided at the center. A plurality of vertical partitions 31 are provided side by side on the upper and lower surfaces of the horizontal partition 29 so that terminal reception chambers 33 are defined by the spaces between the partitions 31 respectively. That is, a plurality of terminal reception chambers 33 are provided horizontally in each of the two, upper and lower stages of the housing 23.

Closing plates 35 are provided across the partitions 31 on the upper and lower surfaces of the top end side of the housing 23, so that the closing plates 35 close the openings of the upper and lower surfaces of the terminal reception chambers 33, thereby forming an insertion portion into which the top end portions of the pressure-contact terminals 25 are inserted. Terminal connection windows 37 respectively communicating with the terminal reception chambers 33 are opened in the top end surface of the housing 23. Electrical connection portions of a mating connector to be connected are inserted into the terminal connection windows 37. An engagement projection 39 is provided in each of the closing plates 35 to project thereon so that the engagement projection 39 acts as a fixation means for fixing the cover 27.

Hollow portions 41 formed by cutting edge portions of the partitions 31 in the upper and lower stages are cut respectively so as to form hollow portions 41 which are disposed on a straight line perpendicular to a side surface 23*a* of the housing.

On the other hand, each of the pressure-contact terminals 25 received in the terminal reception chambers 33 is constituted by an electrical contact portion 25*a* formed at the front end portion, a pressure-contact portion 25*b* formed at the center portion, a wire holding portion 25*c* formed at the rear end portion, and a substrate 25*d* which connects the above portions 25*a*, 25*b* and 25*c*, as shown in FIG. 2. The pressure-contact portion 25*b* has opposite side plates 25*e* formed in parallel to each other by raising projection pieces on the opposite sides of the substrate 25*d*, and pressure-contact blades 25*f* formed by further inward bending the front and rear edges of the side plates 25*e*. Notch portions 25*h* are formed in the upper edges of the side plates 25*e* respectively. The notch portions 25*h* are cut out up to a position which is deeper than the upper end of a wire which is pressed against the pressure-contact blades 25*f*, as shown in FIG. 3. An elastic engagement means not shown is provided in each of the terminal reception chambers 33. The elastic engagement means engages with the rear portion of the electrical contact portion 25*a* so that the pressure-contact terminal 25 is held in the terminal reception chamber 33 so as not to be detached. In the pressure-contact terminal 25 held in a predetermined position in such a manner, the notch portions 25*h* are made coincident with the hollow portions 41 of the partitions 31.

The cover 27 is fitted to the outer periphery of the housing 23 from the direction of the side wall of the housing 23 as shown in FIG. 1. The cover 27 is constituted by a single member formed of upper and lower plates 43*a* and 43*b*, and a side wall 45 connecting the upper and lower plates 43*a* and 43*b* to each other. The cover 27 is a U-shaped when viewed from the rear side. An insertion hole 47 formed in the other side wall of the cover 27 is horizontally fitted to the housing 23. Rail-like projections 49*a* and 49*b* extended perpendicularly to the side wall 45 are provided on the inner sides of the upper and lower plates 43*a* and 43*b* so as to project thereon. The rail-like projections 49*a* and 49*b* are inserted into the hollow portions 41 and the notch portions 25*h* which are disposed so as to be coincident with each other as mentioned above when the cover 27 is fitted to the housing 23. In addition, engagement holes 51 are provided in the upper and lower plates 43*a* and 43*b* so as to engage with the engagement projections 39 of the closing plates 35 to thereby completely fix the cover 27 to the housing 23.

The operation of the pressure-contact connector 21 configured thus will be described.

When the pressure-contact terminals 25 are mounted in predetermined positions in the terminal reception chambers 33 of the housing 23, the hollow portions 41 of the partitions 31 and the notch portions 25*h* of the pressure-contact terminals 25 are coincident with each other so as to form grooves on a straight line perpendicular to the housing side surfaces 23*a*.

Wires 53 are pressed against the pressure-contact terminals 25 received in the terminal reception chambers 33 so that the wires 53 lie across the lower portion of the grooves as shown in FIG. 3.

When the cover 27 is fitted to the housing 23, the rail-like projections 49*a* and 49*b* of the cover 27 are inserted into the grooves, and disposed in the notch portions 25*h* of the pressure-contact terminals 25 held in the terminal reception chambers 33.

The rail-like projections 49*a* and 49*b* disposed in the notch portions 25*h* contact with the upper portions of the wires 53 which are brought into contact with the pressure-contact blades 25*f* so that the wires 53 are prevented from moving up and down. In this state, the engagement projections 39 of the housing 23 engage with the engagement holes 51 of the cover 27 so that the cover 27 is fitted to the outer periphery of the housing 23 in the condition that the cover 27 makes the rail-like projections 49*a* and 49*b* prevent the wires 53 from moving up and down.

Figure 4A:
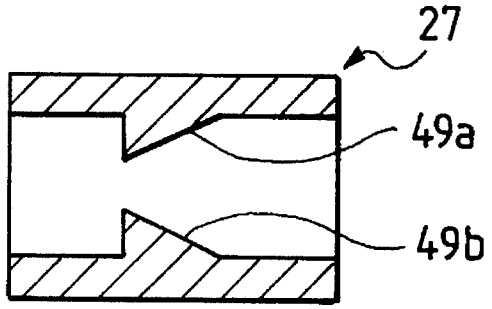
Figure 4B:
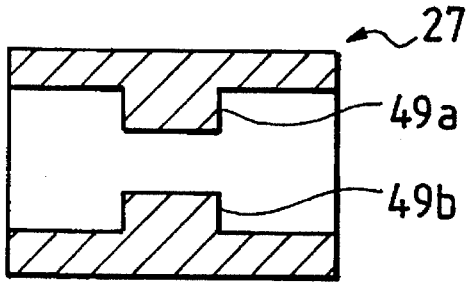
Figure 5:
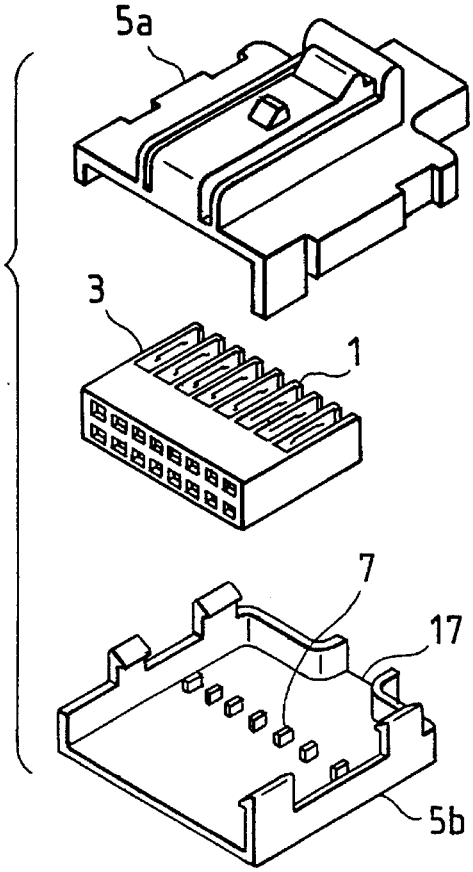
FIG. 5 PRIOR ART
FIG. 5 is an exploded perspective view of a conventional pressure-contact connector.
Figure 6:
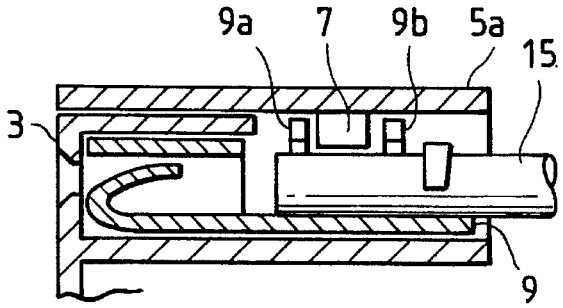
FIG. 6 PRIOR ART
FIG. 6 is a sectional view of a terminal reception chamber after assembling.
Figure 7:
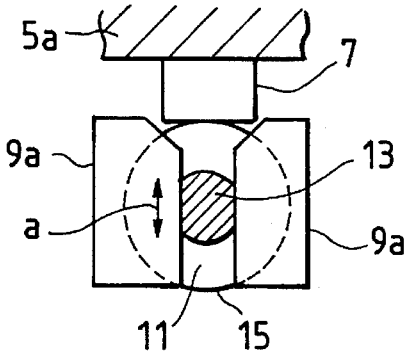
FIG. 7 PRIOR ART
FIG. 7 is a front view showing the state where a wire is pressure-contacted.

The rail-like projections 49*a* and 49*b* in this embodiment are formed to be triangular in section as shown in FIG. 4(*a*). Having such a sectional shape, the rail-like projections 49*a* and 49*b* not only prevent the wires 53 from moving up and down as mentioned above, but also eat the wires 53 at top ends of the triangular shapes to an extent not to completely cut the insulating coatings of the wires to thereby restrain the wires 53 from moving also in the length direction.

Alternatively, the rail-like projections 49*a* and 49*b* may be formed to have a flat-top projecting section as shown in FIG. 4(*b*). In this case, it is possible to keep the area contacting with the wires 53 large so that it is possible to press the wires 53 firmly.

As has been described above in detail, in the pressure-contact connector according to the present invention, a cover constituted by a single member is fitted to a housing removably. Further, rail-like projections inserted into hollow portions of partitions and notch portions of pressure-contact terminals when the cover is fitted to the housing are provided in the inner surface of the cover. Accordingly, when the cover is fitted, the rail-like projections contact with the upper portion of wires which are brought into contact with the pressure-contact terminals so that the wires are prevented from moving up and down. Thus, the cover which is constituted by a single member can prevent the wires from moving up and down due to vibrations, or the like, so that both the cost of manufacture and the workability of assembling-can be improved on a large scale.

What is claimed is:

1. A pressure-contact connector, comprising:

pressure-contact terminals having pressure-contact portions for pressure-contacting with wires;

a housing having partitions defining terminal reception chambers for receiving said pressure-contact terminals between said partitions, said terminal reception chambers being arranged side by side in a horizontal direction of said housing; and a cover fitted onto said housing;

wherein said pressure-contact portions include side plates which are opposite to each other in a direction perpendicular to a longitudinal direction of said wires, and said side plates are provided with notch portions cut more deeply than upper ends of said wires pressure-contacted by said pressure-contact portions;

wherein said partitions are provided with hollow portions which coincide with said notch portions when said pressure-contact terminals are mounted in said terminal reception chambers;

wherein said cover includes an upper plate, a lower plate and a side wall connecting said upper plate to said lower plate, and said cover includes an insertion hole for said housing so that said cover is removably fitted onto said housing horizontally; and wherein an inner surface of said cover is provided with rail-like projections so as to project therefrom so that said projections are inserted into said notch portions and said hollow portions which coincide with each other, when said cover is fitted onto said housing, so as to be disposed on upper ends of said wires which are pressure-contacted by said pressure-contact portions.

2. A pressure-contact connector according to claim 1, wherein said housing includes a horizontal partition so that said terminal reception chambers are arranged in upper and lower stages in said housing, and said rail-like projections to be inserted into said hollow portions formed at upper and lower portions of said partitions and said notch portions of said pressure-contact terminals arranged in said upper and lower stages are formed on the inner surfaces of said upper and lower plates of said cover.

* * * * *